US011724140B2

(12) United States Patent
Lin

(10) Patent No.: US 11,724,140 B2
(45) Date of Patent: Aug. 15, 2023

(54) FIRE-FIGHTING FOAM STOCK TANK

(71) Applicant: I-Hsing Lin, New Taipei (TW)

(72) Inventor: I-Hsing Lin, New Taipei (TW)

( * ) Notice: Subject to any disclaimer, the term of this patent is extended or adjusted under 35 U.S.C. 154(b) by 59 days.

(21) Appl. No.: 17/510,226

(22) Filed: Oct. 25, 2021

(65) Prior Publication Data

US 2023/0127111 A1 Apr. 27, 2023

(51) Int. Cl.
*A62C 35/02* (2006.01)

(52) U.S. Cl.
CPC ..... *A62C 35/026* (2013.01)

(58) Field of Classification Search
CPC ..... B65D 2590/046
USPC ..... 169/13; 220/530
See application file for complete search history.

(56) References Cited

U.S. PATENT DOCUMENTS 2,758,747 A * 8/1956 Stevens ..... B65D 88/62 406/146
3,286,878 A * 11/1966 Schadt ..... F02K 9/605 220/723
3,658,080 A * 4/1972 Mitchell ..... B65D 88/62 422/256
3,747,800 A * 7/1973 Viland ..... B65D 90/38 220/560.08
3,883,046 A * 5/1975 Thompson ..... B65D 88/62 383/3
3,902,624 A * 9/1975 Stephenson ..... B65D 90/22 220/721
5,913,451 A * 6/1999 Madison ..... B60K 15/061 220/900
6,068,152 A * 5/2000 Meiners ..... B65D 88/62 220/723
6,527,002 B1 * 3/2003 Szakaly ..... B65D 90/38 220/88.1
8,567,636 B2 * 10/2013 Lai ..... F24D 3/1008 220/723
8,651,314 B2 * 2/2014 Lin ..... A62C 35/026 220/723
2008/0164261 A1 * 7/2008 Weber ..... B65D 90/046 220/723
2011/0132904 A1 * 6/2011 Acker ..... F24D 3/1041 220/4.12
2011/0309084 A1 * 12/2011 Wang ..... F17C 1/00 220/601
2012/0018339 A1 * 1/2012 Lin ..... A62C 35/026 206/524.3
2012/0152959 A1 * 6/2012 Lai ..... F16L 55/055 220/530
2022/0412862 A1 * 12/2022 Li ..... B01D 19/0057
(Continued)

*Primary Examiner* — Joseph A Greenlund
(74) *Attorney, Agent, or Firm* — Pai Patent & Trademark Law Firm; Chao-Chang David Pai

(57) ABSTRACT

A fire-fighting foam stock tank includes a stock solution tank, a bladder set inside the stock solution tank, and a liquid collecting pipe installed inside the bladder. The stock solution tank has a first end tank wall provided with a first maintenance hole and a first hole cover. There is a hole plug on the inner surface of the first hole cover, so that the hole plug extends into the first maintenance hole until it is close to the inner wall surface of the stock solution tank, so that the inner wall surface is kept flat. The liquid collecting pipe is a T-shaped pipe composed of a first pipe section and a second pipe section. The bladder fits the liquid collecting pipe shape.

2 Claims, 4 Drawing Sheets

(56) References Cited

U.S. PATENT DOCUMENTS

2023/0127111 A1* 4/2023 Lin ..... A62C 99/0036
169/13

* cited by examiner

FIRE-FIGHTING FOAM STOCK TANK

BACKGROUND OF THE INVENTION

(a) Field of the Invention

The present invention relates to a fire-fighting foam stock tank, in particular to a fire-fighting foam stock tank that can prevent the internal structure of the stock solution tank from obstructing the maintenance hole, and can prevent the internal bladder of the stock solution tank from exploding from the maintenance hole.

(b) Description of the Prior Art

The conventional fire-fighting foam stock tank, such as the structure improvement of the foam tank of U.S. Pat. No. 8,651,314, which includes a foam tank, a bag and a foam tube, in which the foam tank is equipped with a manhole and a hole cover, and the upper and lower tank walls are individually placed with a foam injection hole, an inlet opening and a drain opening; the bag is integrated with the hollow bag body within the foam tank, and the upper and lower ends individually connect with a foam injection hole, particularly, the bag has double bag walls forming interlayer space therebetween, and plural anti-wear items integrate within the interlayer space; and the foam tube is installed within the bag and connects the foam injection hole of the foam tank, and plural open-apertures are placed at the tube wall; thereby providing a foam tank structure which improves the durability and operating life of the bag.

In this way, the fire-fighting foam stock solution is injected into the bag from the above foam injection hole until the bag is saturated and stored. To use the fire-fighting foam stock solution, water is injected from the water injection hole above the foam tank to compress the outer wall of the bag, so that the fire-fighting foam stock solution in the bag enters the liquid collecting pipe, and then flows out of the foam injection hole to mix with other water into a fire-fighting foam.

However, the above-mentioned conventional structure implements the liquid collecting pipe into a cross pipe, and the ends of the liquid collecting pipe are connected and fixed to the maintenance manhole respectively. Therefore, the maintenance personnel will be blocked by the liquid collecting pipe when entering from the maintenance manhole. Part of the liquid collecting pipe must be removed before they can enter the foam tank smoothly, which causes inconvenience.

SUMMARY OF THE INVENTION

The present invention has been accomplished under the circumstances in view. It is the main object of the present invention to provide a fire-fighting foam stock tank, which improves the liquid collecting pipe and bladder in the stock solution tank so that the liquid collecting pipe will not block the maintenance hole where people enter and improves the hole cover on one side to prevent the bladder from exploding when it expands, so as to facilitate the access to the stock solution tank for maintenance and prevent the bladder from rupturing.

In order to achieve the above object, the fire-fighting foam stock tank of the present invention comprises a stock solution tank, which comprises a first end tank wall provided with a first maintenance hole and a first hole cover, a second end tank wall provided with second maintenance hole and a second hole cover, an upper tank wall provided with a foam injection hole and a water inlet hole, and a lower tank wall provided with a foam injection hole and a drainage hole; a bladder, which is a hollow bag set inside the stock solution tank and used to inject a foam stock solution from the foam injection holes; and a liquid collecting pipe incorporated in the bladder and used to divert the foam stock solution in the bladder when the bladder is compressed;

wherein:

the first hole cover comprises a flange and a hole plug protruding from an inner surface of the flange, the flange being locked around the first maintenance hole, the hole plug extending into the first maintenance hole to close to an inner wall surface of the first end tank wall of the stock solution tank;

the bladder comprises a first side surface, which is a closed bladder wall facing the first maintenance hole of the stock solution tank, an upper end surface and a lower end surface respectively connected to the foam injection holes, and a second side surface extending toward the second maintenance hole of the stock solution tank and combined with the second maintenance hole;

the liquid collecting pipe comprises a first pipe section and a second pipe section, the first pipe section being vertically connected between the two foam injection holes of the stock solution tank, the second pipe section being transversely disposed with one end thereof connected to the first pipe section and an opposite end thereof connected to the second maintenance hole.

The present invention improves the liquid collecting pipe into a T-shaped pipe structure, and improves the bladder to adapt to the shape of the liquid collecting pipe, so that the structure of the first maintenance hole at the first end of the stock solution tank is an unobstructed structure for people to enter. It uses the first hole cover to cover the first maintenance hole, so that maintenance personnel can enter and exit smoothly, without disassembling the liquid collecting pipe, so it can easily enter the stock solution tank for maintenance. In addition, the hole plug of the first hole cover of the present invention extends into the first maintenance hole until it is close to the inner wall surface of the first end tank wall of the stock solution tank, which can prevent the bladder from being squeezed into the first maintenance hole when it expands, thereby achieving the effect of preventing the rupture of the bladder.

DETAILED DESCRIPTION OF THE PREFERRED EMBODIMENTS

Figure 1:
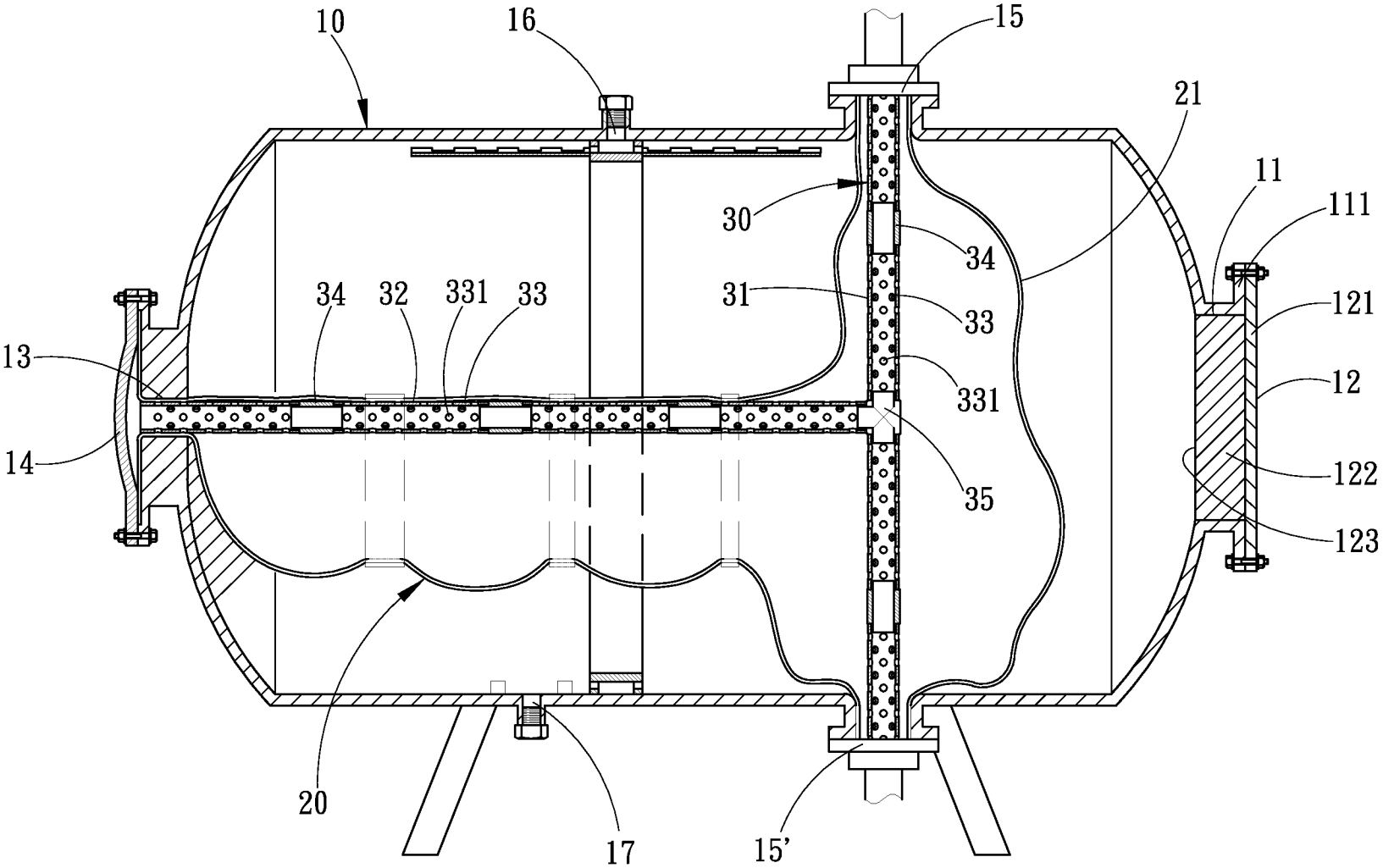
FIG. 1 is a schematic cross-sectional view of a preferred embodiment of the fire-fighting foam stock tank of the present invention.
Figure 2:
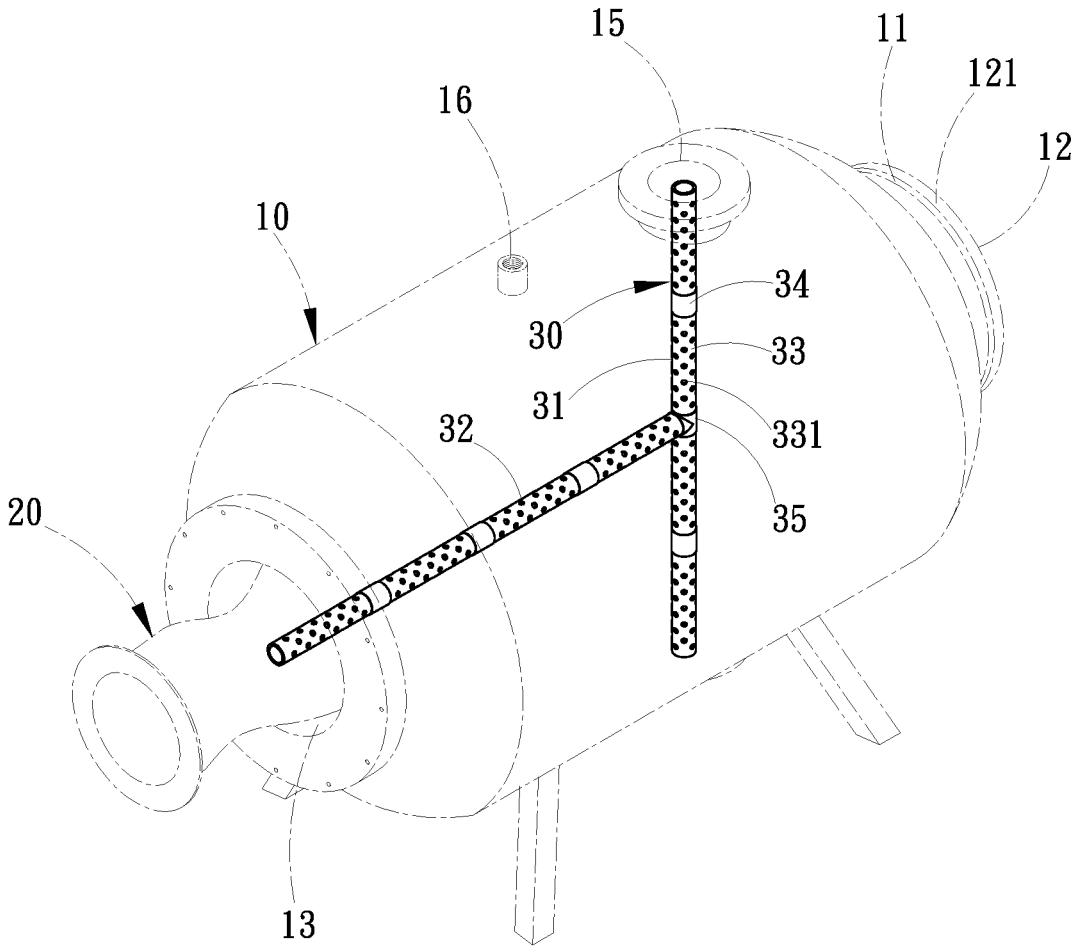
FIG. 2 is a three-dimensional schematic view of the preferred embodiment of the fire-fighting foam stock tank of the present invention.
Figure 3:
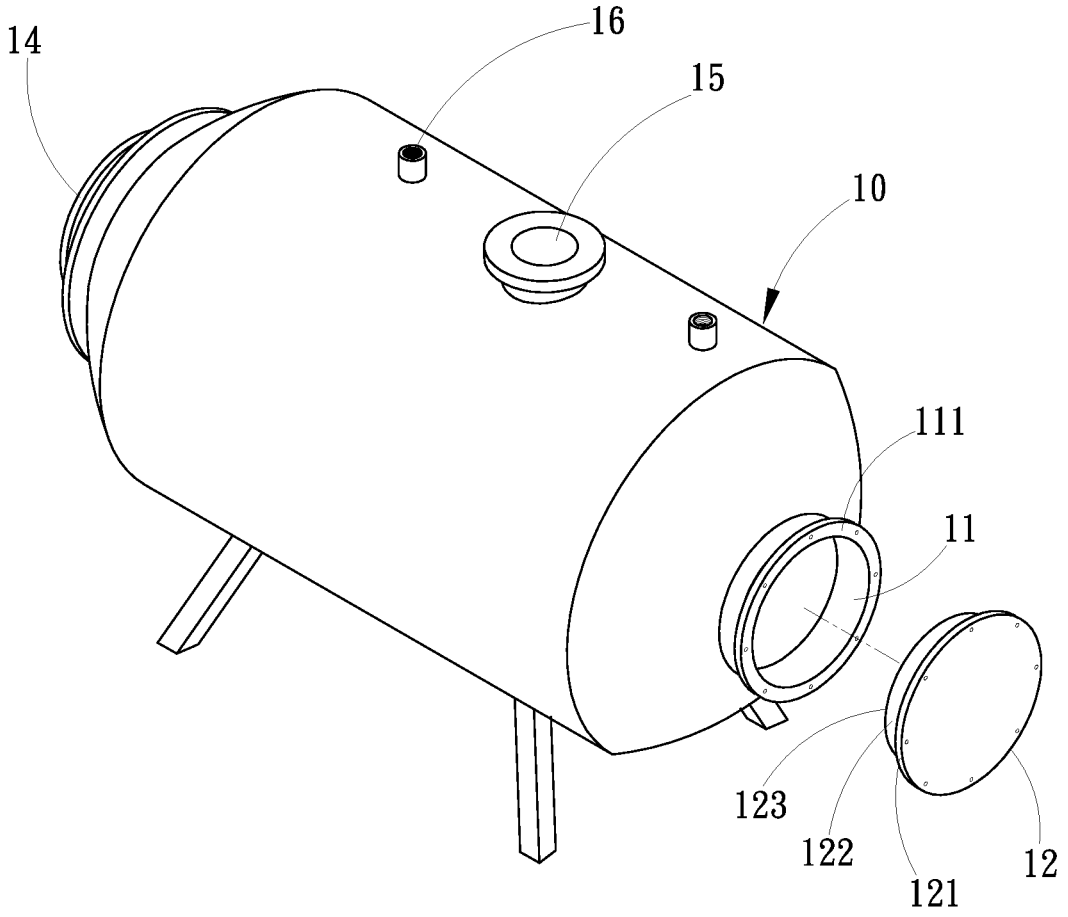
FIG. 3 is an exploded schematic diagram of the preferred embodiment of the stock solution tank and the first hole cover of the present invention.

Referring to FIGS. 1, 2 and 3, the fire-fighting foam stock tank of the present invention is a fire-fighting foam stock tank used to store fire-fighting foam stock solution. When the fire-fighting foam stock solution needs to be used, the fire-fighting foam stock tank is squeezed out by the water pressure injected into the tank, its preferred embodiment comprises a stock solution tank 10, a bladder 20 and a liquid collecting pipe 30.

The stock solution tank 10 is a cylindrical tank formed by welding steel plates, which is preferably implemented as a horizontal structure. A first end tank wall of the stock solution tank 10 is provided with a first maintenance hole 11 and a first hole cover 12. A second end tank wall of the stock solution tank 10 is provided with a second maintenance hole 13 and a second hole cover 14. An upper tank wall and a lower tank wall of the stock solution tank 10 are respectively provided with a first foam injection hole 15 and a second foam injection hole 15', and the upper tank wall is additionally provided with a water inlet hole 16, and the lower tank wall is additionally provided with a drainage hole 17. The water inlet hole 16 is used to connect to a water source to allow water to flow into the stock solution tank 10, and the drainage hole 17 is used to discharge the water in the stock solution tank 10.

The bladder 20 is a hollow bag set inside the stock solution tank 10, which is used to inject the foam stock solution from the first foam injection hole 15 and the second foam injection hole 15', so that the bladder 20 is expanded and filled with the foam stock solution and stored in the stock solution tank 10. The liquid collecting pipe 30 is a pipe body incorporated in the bladder 20. When water flows through the water inlet hole 16 into the stock solution tank 10, the water pressure in the stock solution tank 10 can compress the bladder 20, so that the foam stock solution in the bladder 20 flows to the liquid collecting pipe 30, then flows out from the liquid collecting pipe 30 and the first foam injection hole 15 and the second foam injection hole 15' and then mixes with water in other pipelines to form a foam liquid for fire fighting.

Referring to FIGS. 1 and 3 again, the improved feature of the present invention is outlined hereinafter. The first hole cover 12 of the stock solution tank 10 comprises a flange 121 and a hole plug 122 protruding from the inner surface of the flange 121. The flange 121 is used to lock the flange ring 111 around the first maintenance hole 11. The hole plug 122 has a diameter slightly smaller than the first maintenance hole 11, so that the hole plug 122 extends into the first maintenance hole 11 until its end surface is close to the inner wall surface of the first end tank wall of the stock solution tank 10. Preferably, the end surface 123 of the hole plug 122 of the first hole cover 12 is flush with the inner wall surface of the first end tank wall of the stock solution tank 10, so that the end surface 123 of the hole plug 122 is used to resist the first side surface 21 of the bladder 20 when it is expanded.

The first side surface 21 of the above-mentioned bladder 20 is the closed bag wall facing the first maintenance hole 11 of the stock solution tank 10. The upper and lower end surfaces of the bladder 20 are connected to the first foam injection hole 15 and the second foam injection hole 15'. The second side surface of the bladder 20 extends toward the second maintenance hole 13 of the stock solution tank 10, and is combined with the second maintenance hole 13. The liquid collecting pipe 30 comprises a first pipe section 31 and a second pipe section 32. The first pipe section 31 is vertically connected between the first foam injection holes 15 and the second foam injection hole 15' of the stock solution tank 10. The second pipe section 32 is transversely disposed with one end thereof connected to the first pipe section 31, and an opposite end thereof connected to the second maintenance hole 13. The first pipe section 31 and the second pipe section 32 each preferably comprise a plurality of connecting pipes 33 and pipe joints 34, and the pipe wall of each of the connecting pipes 33 is provided with a plurality of openings 331. Utilize a three-way joint 35 to connect and combine the first pipe section 31 and the second pipe section 32, so that the liquid collecting pipe 30 forms a T-shaped pipe.

Figure 4:
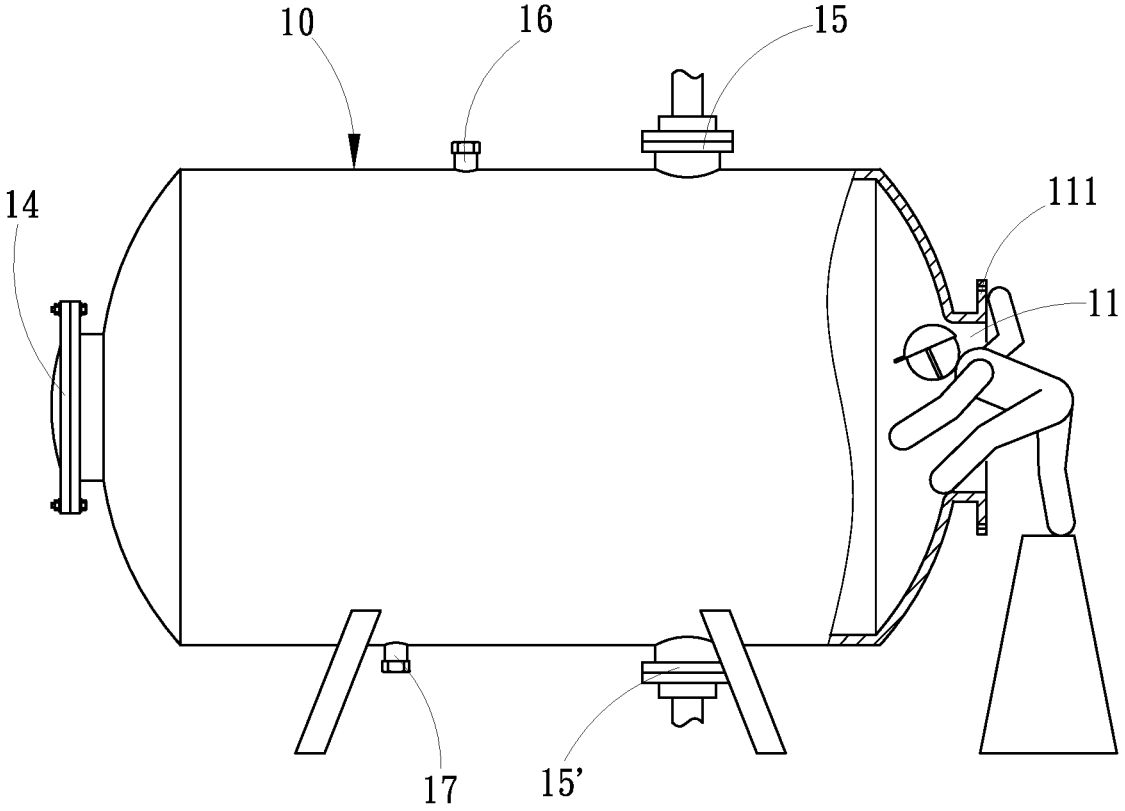
FIG. 4 is a schematic diagram of the first maintenance hole of the present invention providing personnel access.

The present invention improves the vertical first pipe section 31 and the horizontal second pipe section 32 of the liquid collecting pipe 30 into a T-shaped pipe structure, and improves the bladder 20 to adapt to the shape of the liquid collecting pipe 30, so that the first side surface 21 facing the first maintenance hole 11 is a closed bag wall structure. In this way, the structure of the first maintenance hole 11 at the first end of the stock solution tank 10 is an unobstructed structure for people to enter. It uses the first hole cover 12 to cover the first maintenance hole 11, so that maintenance personnel can enter and exit smoothly (as shown in FIG. 4), without disassembling the liquid collecting pipe 30, so it can easily enter the stock solution tank for maintenance.

In addition, the hole plug 122 of the first hole cover 12 of the present invention extends into the first maintenance hole 11 until its end surface 123 is close to the inner wall surface of the first end tank wall of the stock solution tank 10. When the bladder 20 is injected into the fire fighting foam stock solution and swells, it can prevent the first side surface 21 of the bladder 20 from being squeezed into the first maintenance hole 11 to cause the risk of rupture, thereby achieving the effect of preventing the rupture of the bladder.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A fire-fighting foam stock tanks, comprising:

a stock solution tank comprising a first end tank wall provided with a first maintenance hole and a first hole cover, a second end tank wall provided with second maintenance hole and a second hole cover, an upper tank wall provided with a first foam injection hole and a water inlet hole, and a lower tank wall provided with a second foam injection hole and a drainage hole;

a bladder being a hollow bag set inside said stock solution tank and used to inject a foam stock solution from said first and second foam injection holes; and a liquid collecting pipe incorporated in said bladder and used to divert the foam stock solution in said bladder when said bladder is compressed;

wherein:

said first hole cover comprises a flange and a hole plug protruding from an inner surface of said flange, said flange being locked around said first maintenance hole, said hole plug extending into said first maintenance hole;

said bladder comprises a first side surface, which is a closed bladder wall facing said first maintenance hole of said stock solution tank, an upper end surface and a lower end surface respectively connected to said first and second foam injection holes, and a second side surface extending toward said second maintenance hole of said stock solution tank and combined with said second maintenance hole;

said liquid collecting pipe comprises a first pipe section and a second pipe section, said first pipe section being vertically connected between said first foam injection hole and said second foam injection hole of said stock solution tank, said second pipe section being transversely disposed with one end thereof connected to said first pipe section and an opposite end thereof connected to said second maintenance hole; and a distal end of said hole plug away from said flange of said first hole cover is flush with an inner wall surface of said first end tank wall of said stock solution tank for resisting said first side surface of said bladder when said bladder expands.

2. The fire-fighting foam stock tank as claimed in claim 1, wherein said first pipe section and said second pipe section of said liquid collecting pipe each comprise a plurality of connecting pipes and pipe joints, the pipe wall of each said connecting pipe being provided with a plurality of openings, said first pipe section and said second pipe section being connected together with a three-way joint to form a T-shaped pipe.

* * * * *